US010639556B2

(12) United States Patent
Sinn et al.

(10) Patent No.: US 10,639,556 B2
(45) Date of Patent: May 5, 2020

(54) SYSTEM FOR A TILTING AMUSEMENT RIDE

(71) Applicant: MONTPARNASSE 56 USA LLC, New York, NY (US)

(72) Inventors: Robert Sinn, Lisle, IL (US); John Peronto, Wilmette, IL (US)

(73) Assignee: Montparnasse 56 USA LLC, New York, NY (US)

( * ) Notice: Subject to any disclaimer, the term of this patent is extended or adjusted under 35 U.S.C. 154(b) by 0 days.

(21) Appl. No.: 16/013,277

(22) Filed: Jun. 20, 2018

(65) Prior Publication Data

US 2019/0118102 A1 Apr. 25, 2019

Related U.S. Application Data

(63) Continuation of application No. 15/541,147, filed as application No. PCT/US2015/067983 on Dec. 30, 2015, now abandoned.

(60) Provisional application No. 62/098,223, filed on Dec. 30, 2014.

(51) Int. Cl.

| | |
|---|---|
| ***A63G 31/02*** | (2006.01) |
| ***A63G 31/10*** | (2006.01) |
| ***E04B 1/24*** | (2006.01) |
| ***E04B 1/344*** | (2006.01) |
| ***E06B 3/04*** | (2006.01) |
| ***E06B 3/38*** | (2006.01) |
| ***E06B 5/00*** | (2006.01) |

(52) U.S. Cl.

CPC ..... *A63G 31/02* (2013.01); *A63G 31/10* (2013.01); *E04B 1/24* (2013.01); *E04B 1/344* (2013.01); *E06B 3/04* (2013.01); *E06B 3/38* (2013.01); *E06B 5/00* (2013.01)

(58) Field of Classification Search

CPC ..... A63G 31/00; A63G 31/08; A63G 31/10; A63G 31/16

USPC ..... 472/2, 131, 136

See application file for complete search history.

(56) References Cited

U.S. PATENT DOCUMENTS

| | | | | |
|---|---|---|---|---|
| 4,973,042 A * | 11/1990 | Klopf | ..... | A63G 1/00 104/79 |
| 6,126,550 A * | 10/2000 | Moser | ..... | A63G 31/00 472/131 |
| 6,592,463 B1 * | 7/2003 | Gnezdilov | ..... | A63G 31/08 472/131 |

OTHER PUBLICATIONS www.360chicago.com/tilt/https://web.archive.org/web/March172014 (Year: 2014).*

* cited by examiner

*Primary Examiner* — Kien T Nguyen

(74) *Attorney, Agent, or Firm* — Graeser Associates International Inc; D'Vorah Graeser

(57) ABSTRACT

A system for a tilting amusement ride installed in a supporting structure and intended to bring a rider from a standing vertical position, to a tilted position while the rider remains prone, the ride comprising: a tilting platform comprising at least one cell to accommodate a rider; at least one actuator attached at its extending end to the platform by a pivoting attachment, wherein the actuator extends to tilt the platform and retracts to retract the platform; at least one back post attached to the at least one actuator at its fixed end by a pivoting attachment and securely attached to the structure; and a supporting frame attached to the platform by a rotational pivot, wherein the platform tilts about the pivot and wherein the frame is securely attached to the structure; wherein the platform has an angle of tilt between 15 and 45 degrees.

20 Claims, 12 Drawing Sheets

SYSTEM FOR A TILTING AMUSEMENT RIDE

FIELD OF THE INVENTION

The present invention is of a system for a tilting amusement ride and in particular, such a system for installation in a building or other tall structure as an attraction.

BACKGROUND OF THE INVENTION

Various amusement rides are known in the art which combine movement in one or more directions with tilting of the rider, as in a centrifugal ride, a simulator or a roller coaster.

Tilting is itself a generally known phenomenon in windows and other devices. For example, European Patent EP0802295 and Chinese Utility Model CN203201358U relate to windows which tilt, but without any reference to amusement rides.

SUMMARY OF THE INVENTION

There is thus an unmet need for, and it would be highly useful to have an amusement ride which is located in a high structure and which tilts, but which does not relate to substantial movement in any other direction.

The tilting ride is installed in a building, tower, housing or structure and these terms are used interchangeably below. The riders of the tilting ride may also be referred to as participants below.

According to some embodiments of the present invention, there is provided a system for a tilting amusement ride installed in a supporting structure and intended to bring a rider from a standing vertical position, to a tilted position while the rider remains prone, the ride comprising: a tilting platform comprising at least one cell to accommodate a rider; at least one actuator attached at its extending end to the platform by a pivoting attachment, wherein the actuator extends to tilt the platform and retracts to retract the platform; at least one back post attached to the at least one actuator at its fixed end by a pivoting attachment and securely attached to the structure; and a supporting frame attached to the platform by a rotational pivot, wherein the platform tilts about the pivot and wherein the frame is securely attached to the structure; wherein the platform has an angle of tilt between 15 and 45 degrees. More preferably, the angle of tilt is between 25 and 35 degrees.

Preferably the cell comprises: at least two L-frames defining the sides of the cell; a glass front that is faced by the rider standing in the cell; and a glass top. Preferably, the ride further comprises an end stop attached to the platform, wherein the end stop engages an end stop buffer when the platform is fully tilted. Preferably, the glass front and the glass top comprise heat treated glass lites with structural interlayers.

Preferably, the tilting platform does not provide substantial movement in any other direction aside from the tilt. Optionally, the ride is retrofitted into an existing supporting structure. Optionally, the ride is constructed as part of the construction of the supporting structure.

Optionally, the cell further comprises at least one handrail. Preferably, the system further comprises a supporting crossbeam attached to the at least one back post. Preferably, the supporting frame further comprises supporting beams attached to form a frame, wherein the supporting beams are securely attached to the structure with support posts.

Preferably, the actuator is selected from the group consisting of: a hydraulic actuator; an electro-mechanical actuator; and a pneumatic actuator. Preferably, the platform further comprises: a base attached to the bottom of the at least two L-frame, the base comprising a support member covered on its top by a floor; and a crossbeam perpendicularly attached to the at least two L-frames. Optionally, the floor comprises a non-slip material.

Optionally, the ride is flush with the structure when retracted. Optionally, the ride protrudes from the structure when retracted.

According to other embodiments of the present invention, there is provided a system for a tilting amusement ride installed in a supporting structure and intended to bring a rider from a standing vertical position, to a tilted position while the rider remains prone, the ride comprising: a tilting platform comprising at least one cell to accommodate a rider; wherein the platform tilts about a rotational pivot attached to the structure; and at least one actuator attached at its extending end to the platform by a pivoting attachment, wherein the actuator extends to tilt the platform and retracts to retract the platform; wherein the actuator is attached to the structure. Preferably, the angle of tilt is between 15 and 45 degrees. Preferably the angle of tilt is between 25 and 35 degrees. Preferably, the tilting platform does not provide substantial movement in any other direction aside from the tilt.

Unless otherwise defined, all technical and scientific terms used herein have the same meaning as commonly understood by one of ordinary skill in the art to which this invention belongs. The materials, methods, and examples provided herein are illustrative only and not intended to be limiting.

Implementation of the method and system of the present invention involves performing or completing certain selected tasks or steps manually, automatically, or a combination thereof. Moreover, according to actual instrumentation and equipment of preferred embodiments of the method and system of the present invention, several selected steps could be implemented by hardware or by software on any operating system of any firmware or a combination thereof.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

The present invention, in at least some embodiments, is of a system for a tilting amusement ride that tilts outwards from the building where it is installed in order to serve as an attraction providing an exciting experience for participants.

According to at least some embodiments, there is provided a tilting amusement ride, intended to bring a rider from a standing vertical position, to a tilted position (while the rider remains prone). The system preferably features several clear layers of heat treated structural laminated glass, which the rider faces in both the standing and tilted positions. Optionally and preferably, the system is intended to be installed at or near the top of a skyscraper, or any other suitably tall structure, so that upon being tilted, the rider views the outside through the glass and has the sensation of being suspended in mid-air while tilted forward. The angle of tilt is preferably in the range of from 15 to 45 degrees, and more preferably 25 to 35 degrees.

Figure 1A:
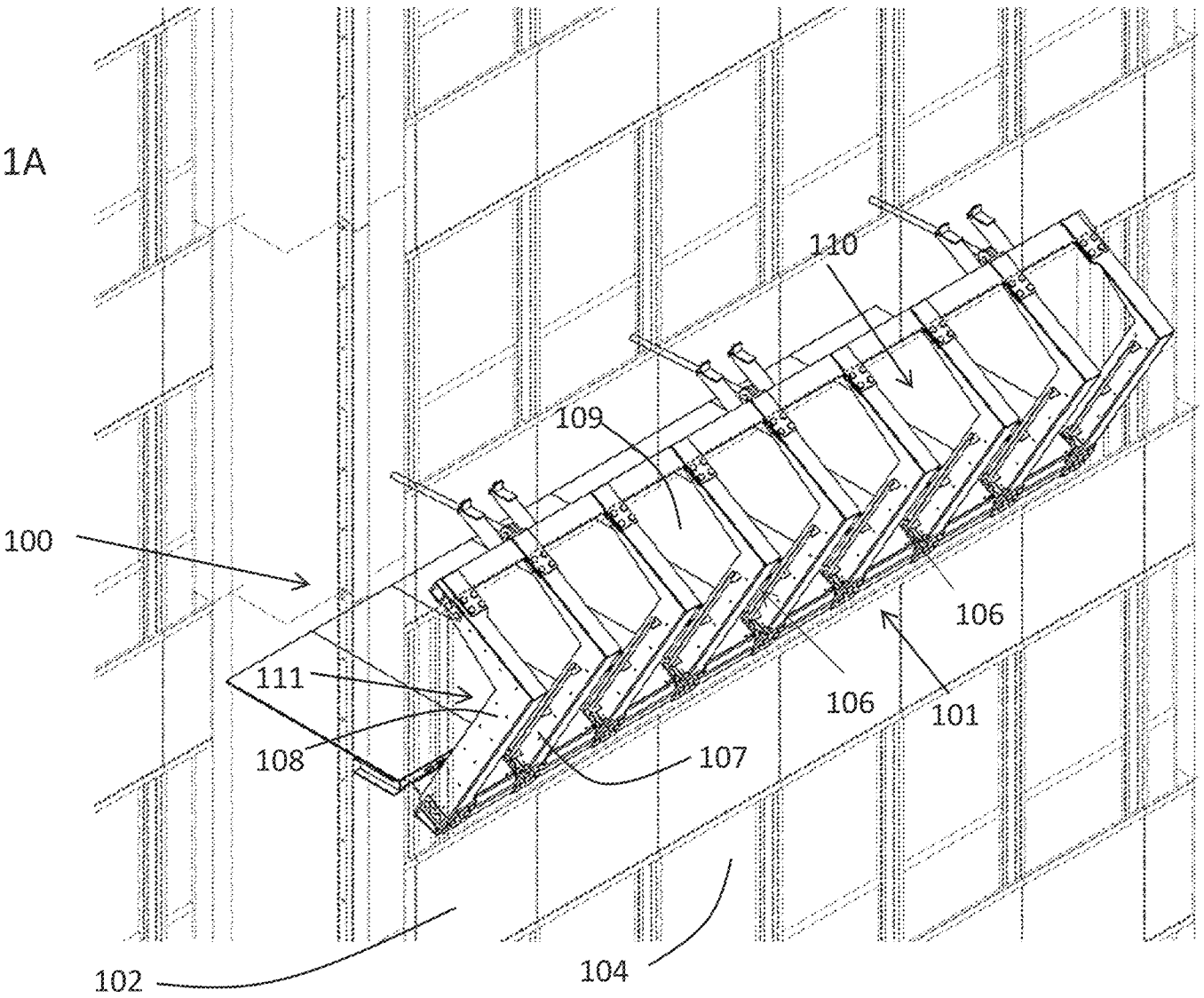
FIGS. 1A-1C are exemplary illustrative drawings showing interior and exterior views of the tilting amusement ride in tilted and retracted positions according to at least some embodiments of the present invention.
Figure 1B:
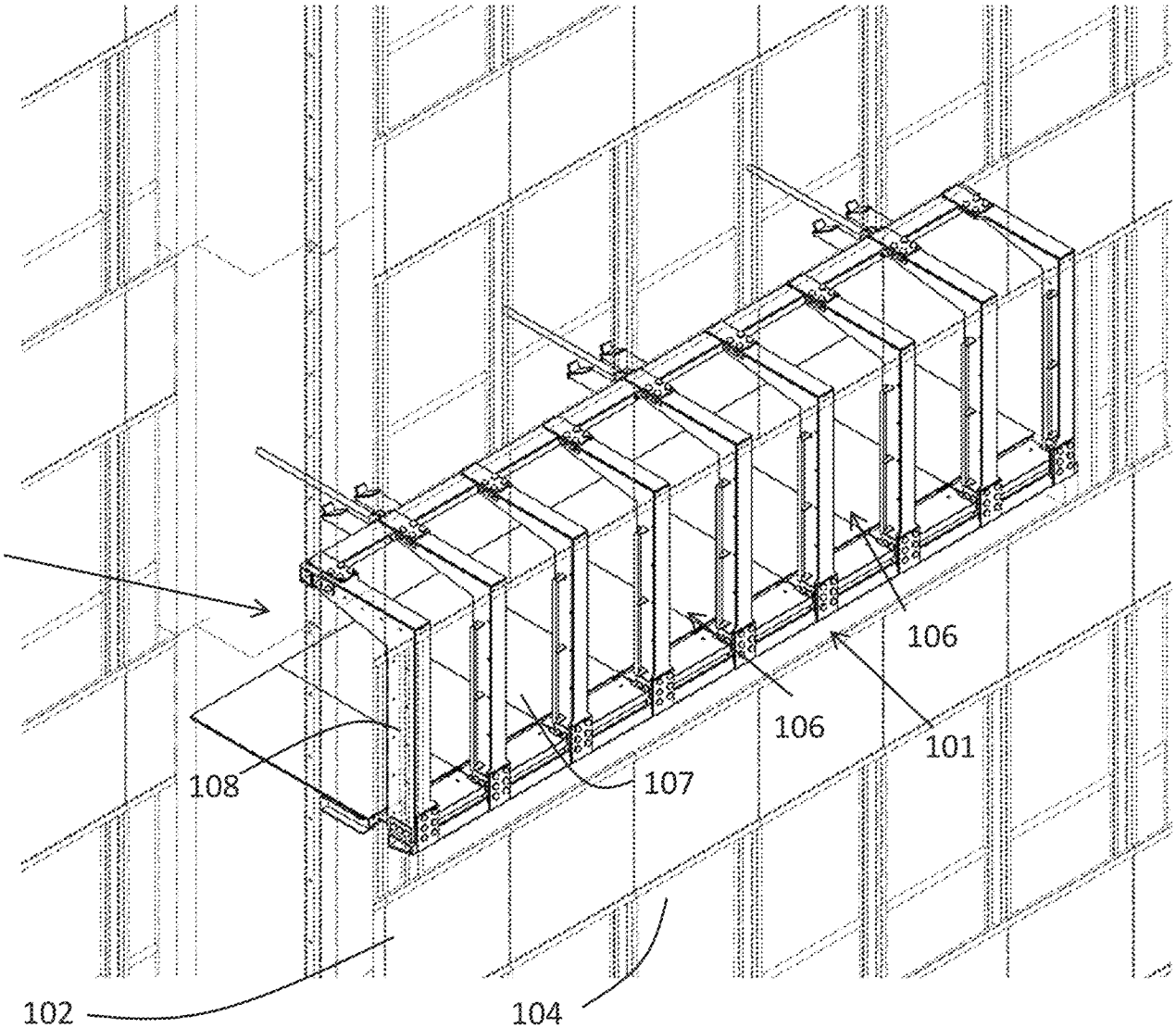
Figure 1C:
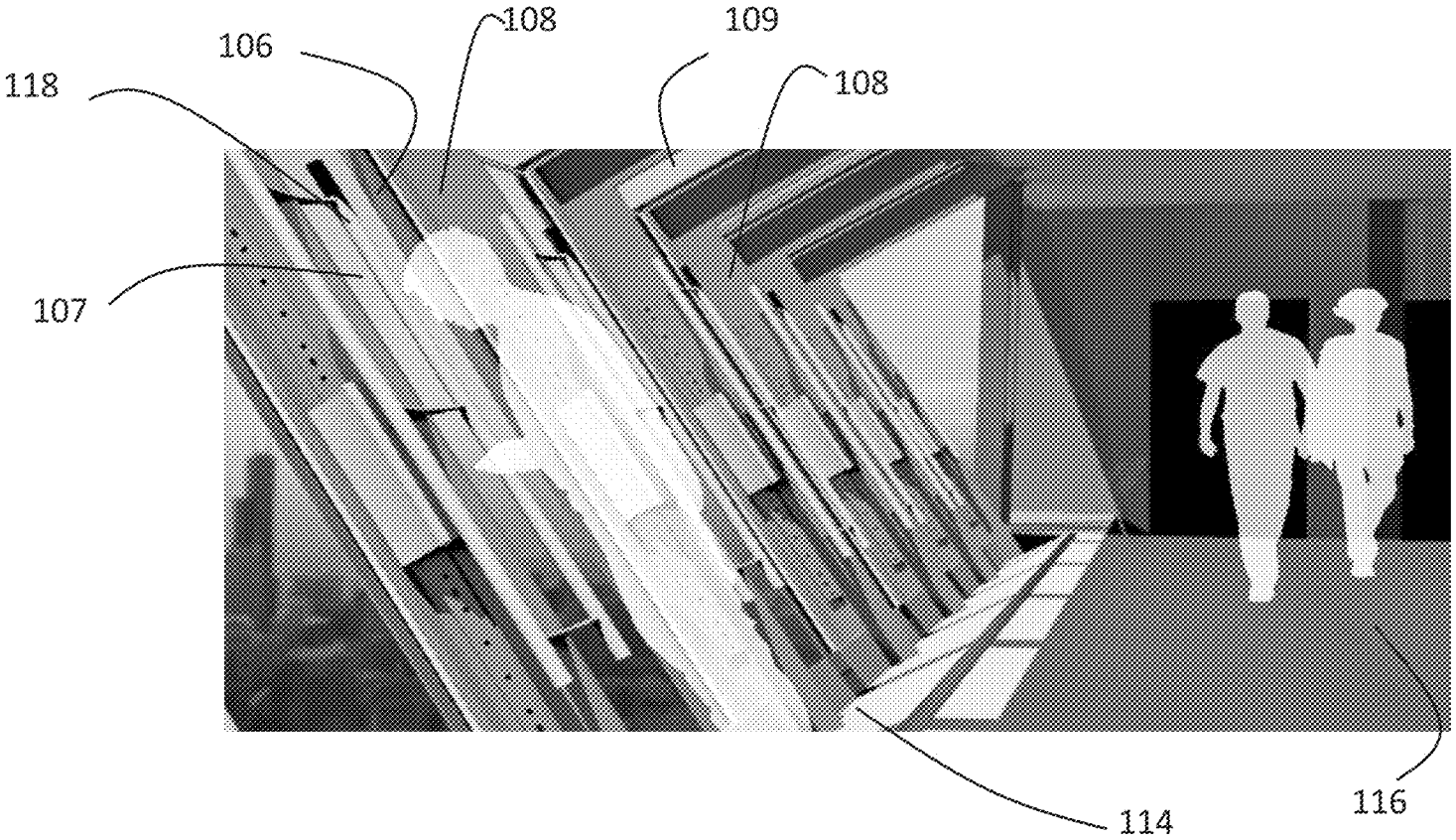

Referring now to the drawings, FIGS. 1A-1C are exemplary illustrative drawings showing interior and exterior views of the tilting amusement ride in tilted and retracted positions according to at least some embodiments of the present invention. As shown in FIG. 1A tilting ride 100 is installed in a building 102. Building 102 is preferably a high-rise building offering scenic city or landscape views. Tilting ride 100 is preferably installed on a high floor in building 102 so as to enhance the view and the enjoyment of participants using the ride 100. Building 102 may optionally be any sort of structure including, but not limited to an office building, hotel or tower. Building 102 can either be a new or existing structure and ride 100 is designed or retrofitted into building 102. Preferably, ride 100 is installed in a new building during construction. Optionally, a structure is constructed specifically to house ride 100. Optionally, more than one ride 100 may be installed in a structure.

In the embodiments shown in FIGS. 1A and 1B as well as the figures below, ride 100 is shown as a generally rectangular structure installed in a generally rectangular building, but ride 100 may optionally be of an arced or circular shape and may be installed in buildings that are not rectangular.

Ride 100 comprises a ride movable platform 101 that is preferably constructed to resemble the facade of building 102 such as existing windows 104. Therefore when retracted, as shown in FIG. 1B, platform 101 appears to be part of building 102. Optionally, platform 101 is of a different facade to emphasize the presence of tilting ride 100 in building 102.

FIG. 1B shows platform 101 in a retracted mode where it is flush with the building. Optionally, platform 101 is flush with the facade of the building. Optionally, platform 101 protrudes out from the building even while in retracted mode.

Platform 101 is initially placed in the retracted position as shown in FIG. 1B and then, as shown in FIG. 1A, platform 101 tilts outwards from building 102. Participants standing inside platform 101 are tilted forward and outward from the building 102 to provide an exciting experience and different views than could be experienced without the tilting platform 101. Platform 101 is therefore preferably installed in a part of the building where the tilted view is not obstructed by building structures below or to the side of platform 101. Once platform 101 is tilted out, ride roof 110, and ride side panels 111 are exposed.

Platform 101 is preferably installed in building 102 in a manner that when in either tilted or retracted modes, the inside of platform 101 and ride waiting area 116 are not exposed to the outside elements. Further, the presence of tilting ride 100 preferably does not affect the building's ability to withstand any weather conditions. Tilting ride 100 is not intended to serve as a weather barrier for building 102. Preferably, building 102 is adapted to outdoor conditions in the area that houses ride 100.

As shown in FIGS. 1A-1C, ride platform 101 is preferably divided into multiple cells 106 that are occupied by standing participants. Cells 106 are divided by divider L-Frames 108 and comprise cell front 107 and cell top 109. Preferably, cell front 107 and cell top 109 comprise a transparent material surrounding the participant such that the view from the cell is enhanced. Preferably, the transparent material is a composite panel comprised of heat treated glass lites with structural interlayers. Optionally the transparent material is reinforced, double-glazed, or tinted or a combination depending on the facade or structural requirements. Optionally the transparent material is PMMA or another glass substitute.

In the illustrated embodiment, platform 101 comprises 8 cells. Optionally, the number of cells may be adjusted to accommodate the structure of the ride 100 and the building 102.

Participants stand within the cells 106 on ride floor 114 which is a part of movable platform 101 and tilts along with platform 101. Participants access cells 106 by stepping onto floor 114 from waiting area 116. When platform 101 is in a retracted position, the floor of floor 114 is level with the floor of area 116. Participants hold onto handrails 118 while standing in platform 101. Handrails 118 may be any suitable material depending on the aesthetic requirements of platform 101. Preferably handrails 118 are of a material or are covered with a non-slip material to allow participants to grip the handrails during tilting.

Ride 100 preferably meets or exceeds all relevant design codes and standards as well as environmental requirements such as imposed by wind load. Safety features are preferably integrated into the design and coordinated with the support structure building 102.

Figure 2A:
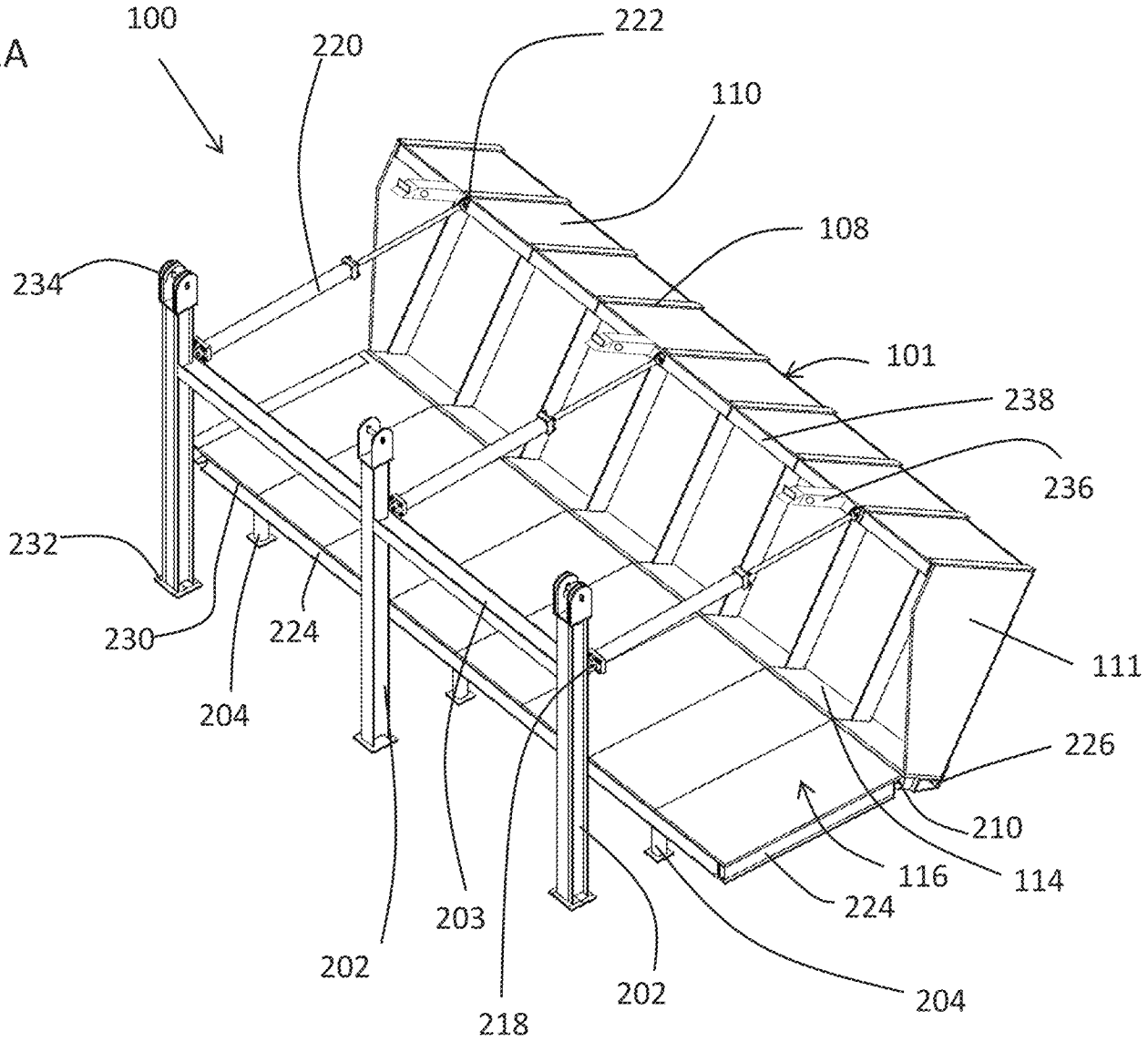
FIGS. 2A-2B are isometric schematic drawings of a tilting ride according to at least some embodiments of the present invention.
Figure 2B:
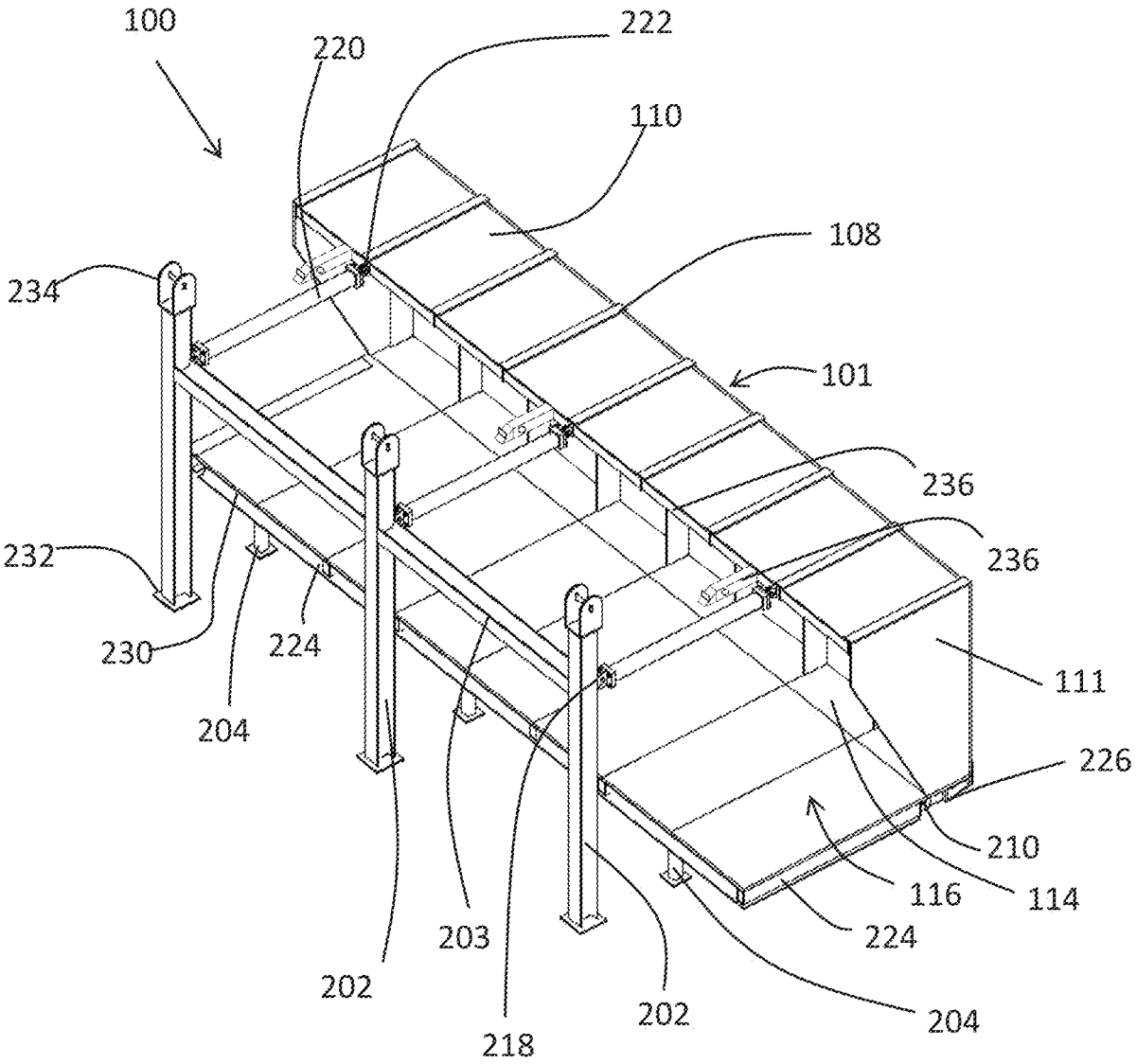

Reference is now made to FIGS. 2A and 2B which are isometric schematic drawings of a tilting ride according to at least some embodiments of the present invention. FIGS. 2A and 2B illustrate the structural parts of the tilting ride 100 that are installed into a building or other structure. FIG. 2A shows the tilting ride in tilt mode and FIG. 2B shows the tilting ride in retracted mode.

Tilting ride 100 is supported by back posts 202 or a similar supporting structure which are joined together by supporting crossbeam 203. Posts 202 are firmly attached, both at post bases 232 and at post top plates 234, to the structure that houses tilting ride 100. The attachment is provided by standard bolted or welded connections or other form of firm attachment as known in the art. Posts 202 and crossbeam 203 are manufactured of steel or other rigid material.

Tilt actuators 220 are attached to posts 202 at actuator pivot pins 218. FIG. 4G shows this connection in more detail. Actuators 220 are optionally any of electro-mechanical, hydraulic, or pneumatic actuators. Actuators 220 are optionally powered by an electric hydraulic pump or similar appropriate pump. Actuators 220 are computer controlled. Actuators 220 have a load capacity suitable to satisfy the operational and safety requirements of tilting ride 100. Exemplary actuators 220 as represented in the figures have a bore of 4 inches, a rod of 2.5 inches and a stroke of 51 inches. Optionally, the load capacity, bore, rod, and stroke of actuators 220 may be different depending on the functional and structural requirements of the tilting ride and the building where it is installed.

Actuators 220 are connected to platform 101 at actuator attachment point 222. Attachment point 222 is shown in more detail in FIG. 4D. Point 222 is defined on platform 101 by platform frame crossbeam 238 that is perpendicularly attached to the ends of L-frames 108. L-frame 108 is constructed from steel or other rigid material conforming to the constructing requirements of tilting ride 100. The spaces between the L-frames 108 define the roof 109 and front 107 of each cell 106.

End stop 236 is attached to crossbeam 238. When platform 101 is tilted, end-stop 236 engages end-stop buffer 402 as shown in FIG. 4F to prevent platform 101 from tilting beyond its designed maximum (along with the stroke of the actuator 220). End stop 236 is constructed from steel or other rigid material conforming to the constructing requirements of tilting ride 100. FIG. 2A shows three end stops 236 but preferably two end stops 236 are attached to crossbeam 238 next to every attachment point 222 with an end stop 236 on either side of actuator 220. Optionally more or less end stops 236 may be provided depending on the requirements of ride 100.

L-frames 108 are attached at their bases to floor 114. The attachment is shown in more detail in FIG. 4C below. Base 114 comprises support members 226 and floor 114. Members 226 are constructed from steel or other rigid material conforming to the design requirements of the ride 100. Floor 114 may be formed of any suitable flooring material depending on the aesthetic requirements of platform 101. Preferably the material for floor 114 is a non-slip material so that participants can stand firmly while platform 101 is tilting.

Support members 226 are attached to rotational pivot connection 210. Pivot 210 is shown in more detail in FIGS. 4B and 4C. In FIGS. 2A and 2B, pivot 210 is shown as positioned at the side of ride 100, however, three or more pivots 210 are preferably placed underneath attachment points 222. Optionally, at least one pivot 210 may be placed as shown in FIGS. 2A and 2B. Pivots 210 are attached to the supporting beams 224 of area 116. Beams 224 form a supporting frame that supports stationary floor 230 of area 116. Beams 224 are constructed from steel or other rigid material conforming to the design requirements of the tilting ride 100. Floor 230 may be formed of any suitable flooring material depending on the aesthetic requirements of tilting ride 100.

Beams 224 are supported by support posts 204 which are firmly attached to the structure 102 that houses tilting ride 100. The attachment is provided by bolted or welded connections or other form of firm attachment as known in the art. Posts 204 are manufactured of steel or other rigid material conforming to the construction requirements of the ride 100. Floor 230 includes access panels (not shown) for inspection and maintenance of pivots 210, beams 224 and posts 204.

In the embodiment shown in FIGS. 2A and 2B, three back posts 202 and three actuators 220 are shown but optionally any number of posts or actuators may be used depending on the functional and structural requirements of the tilting ride and the building where it is installed.

Figure 3:
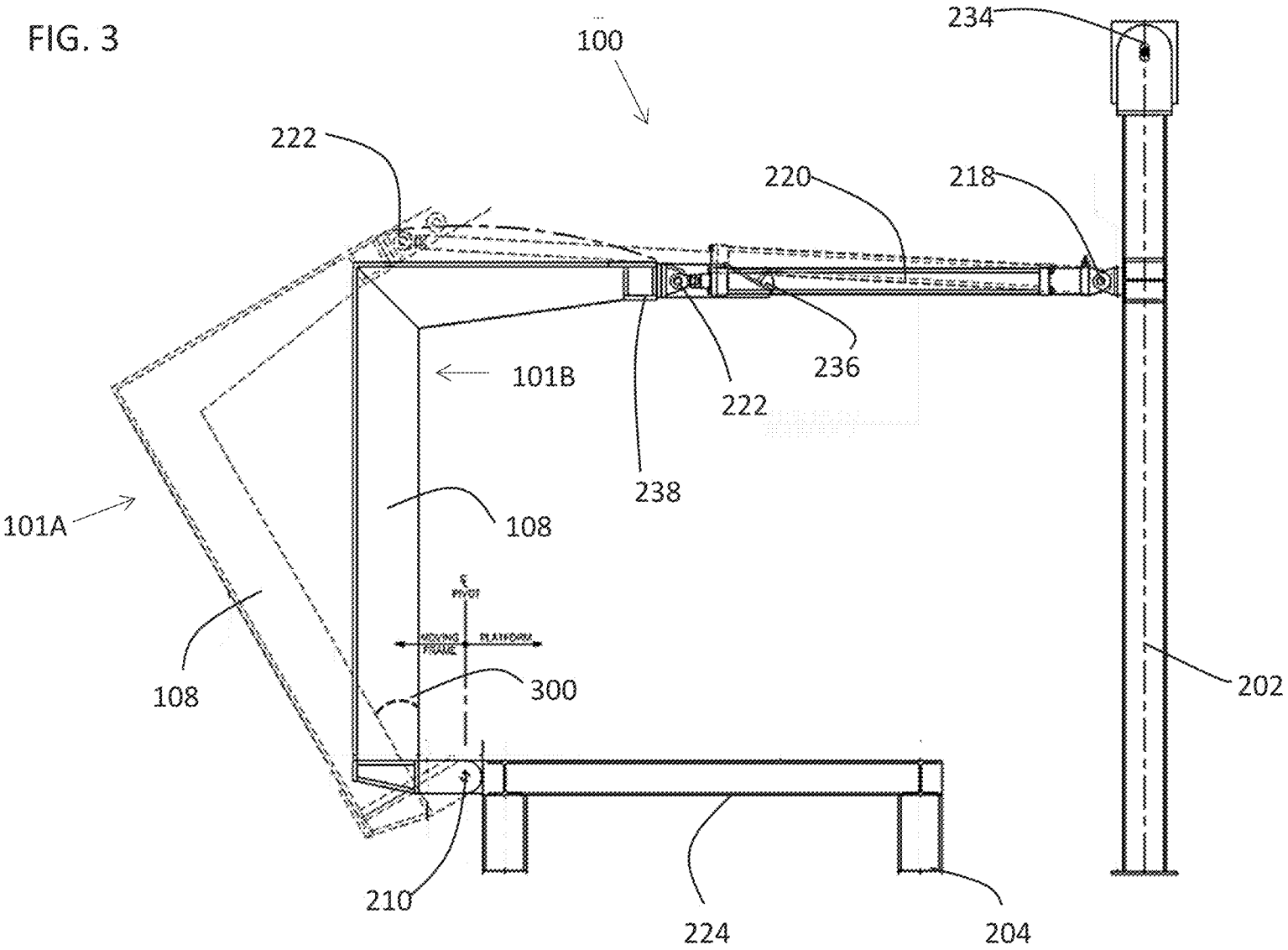
FIG. 3 is an exemplary, illustrative side elevation of a tilting ride according to some embodiments of the present invention.

Reference is now made to FIG. 3 which is an exemplary, illustrative side elevation of a tilting ride according to some embodiments of the present invention. In operation, actuators 220, extend, moving the platform 101 outward into a tilted position 101A or contract moving the platform 101 inward into a retracted position 101B where platform 101 rotates about pivots 210.

The angle of tilt 300 varies according to the requirements of the particular installation. Preferably the angle is between 0 and 45 degrees. More preferably the angle is between 0 and 35 degrees. End stop buffer 402 (shown in FIG. 4E) as well as the stroke of the actuator 220, limit the angle and stop the platform 101 when it has reached its defined maximum tilt angle.

As actuator 220 extends and platform 101 tilts, connection point 222 and end stops 236 rise relative to their retracted position. The installation of ride 100 therefore needs to accommodate this increase in height. Actuator 220 also pivots at pins 218 during extension and retraction. The extension and retraction of actuator 220 is controlled by a computer (not shown) operated by an operator. The tilt speed is determined by the actuator 220, hydraulic or other pump and computer control system. The operator may fully tilt the platform 101 without pausing or alternatively may tilt the platform 101 in gradual increments to enhance the experience of participants.

Reference is now made to FIGS. 4A-4G which are exemplary construction diagrams for a tilting ride according to some embodiments of the present invention. FIGS. 4A to 4G include exemplary dimension, installation and construction information that should not be considered limiting.

Figure 4A:
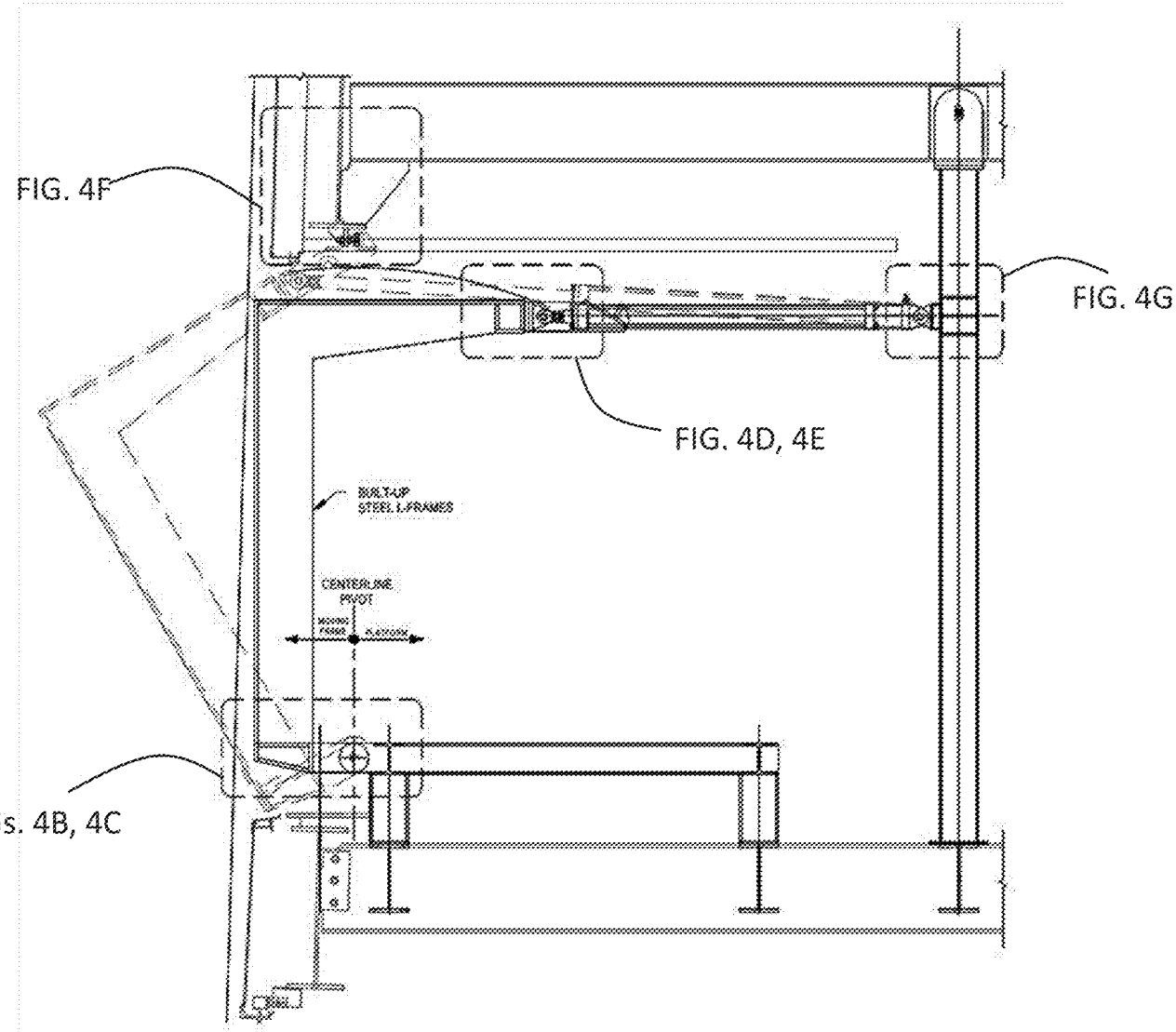
FIGS. 4A-4G are exemplary construction diagrams for a tilting ride according to some embodiments of the present invention.

FIG. 4A is an exemplary construction diagram for a tilting ride according to some embodiments of the present invention. FIG. 4A shows the tilting ride installed in an exemplary building. The areas marked on FIG. 4A are shown in greater detail in FIGS. 4B-4F.

Figure 4B:
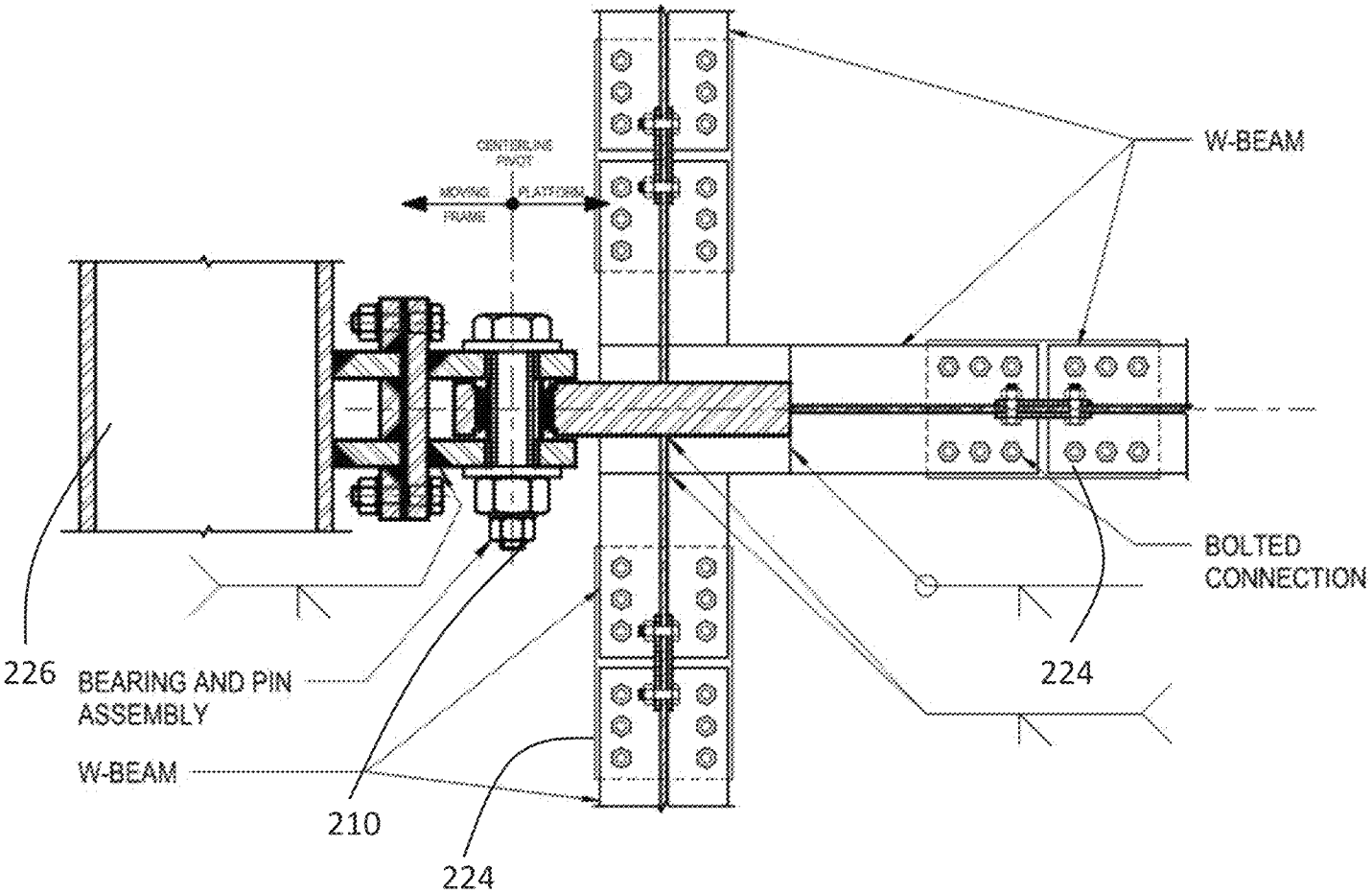

FIG. 4B is an exemplary construction diagram for a tilting ride according to some embodiments of the present invention. FIG. 4B shows a plan sectional view of the attachment of support members 226 to pivot 210 as well as the attachment of pivot 210 to the supporting frame of area 116.

Figure 4C:
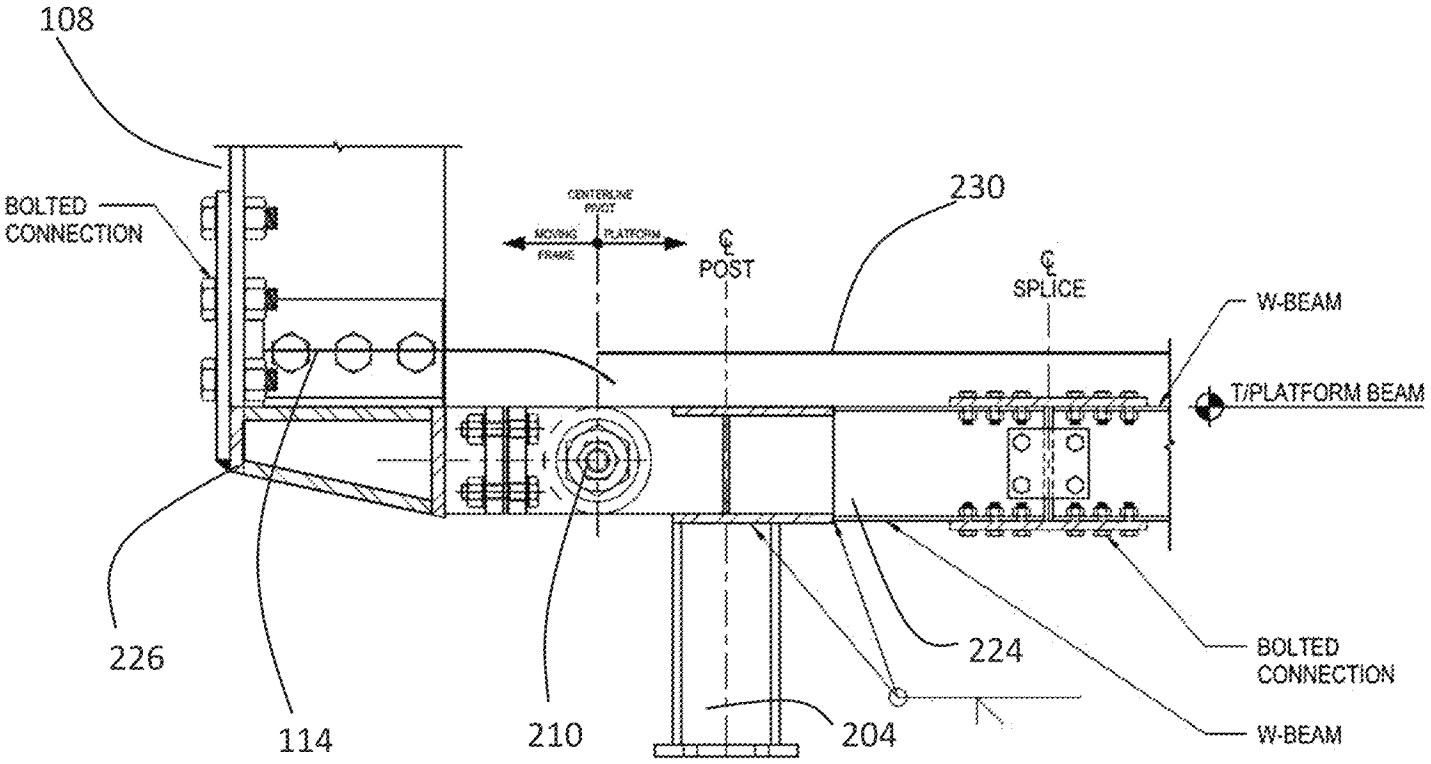

FIG. 4C is an exemplary construction diagram for a tilting ride according to some embodiments of the present invention. FIG. 4C shows a side sectional view of the attachment of support members 226 to pivot 210 as well as the attachment of pivot 210 to the supporting frame of area 116 comprising beams 224 and support posts 204. Floor 114 is shown as folding away under stationary floor 230 of area 116. This arrangement presents a gapless floor to participants of the ride as they step from waiting area 116 onto platform 101 and vice versa. When platform 101 is in tilt mode the floor 114 unfolds but remains under floor 230.

Figure 4D:
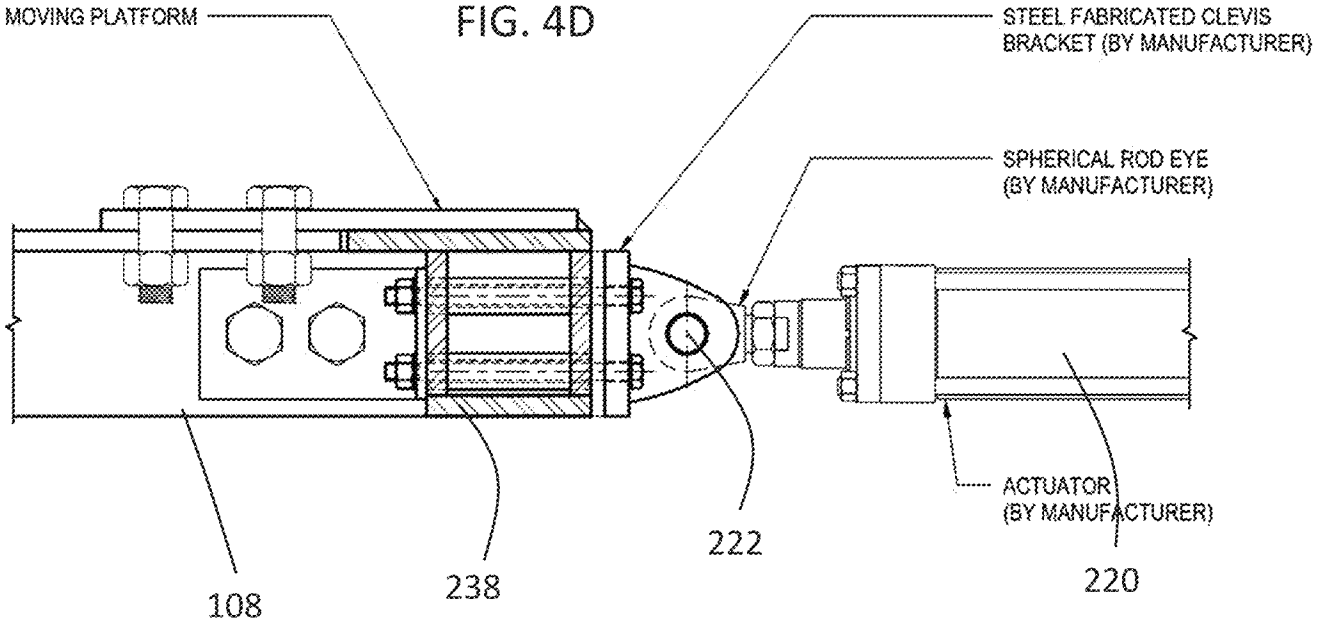

FIG. 4D is an exemplary construction diagram for a tilting ride according to some embodiments of the present invention. FIG. 4D shows a side sectional view of the attachment of actuator 220 to attachment point 222 on platform frame crossbeam 238 which in turn is attached to L-frame 108. Actuator 220 pivots about attachment point 222 as actuator 220 expands and retracts.

Figure 4E:
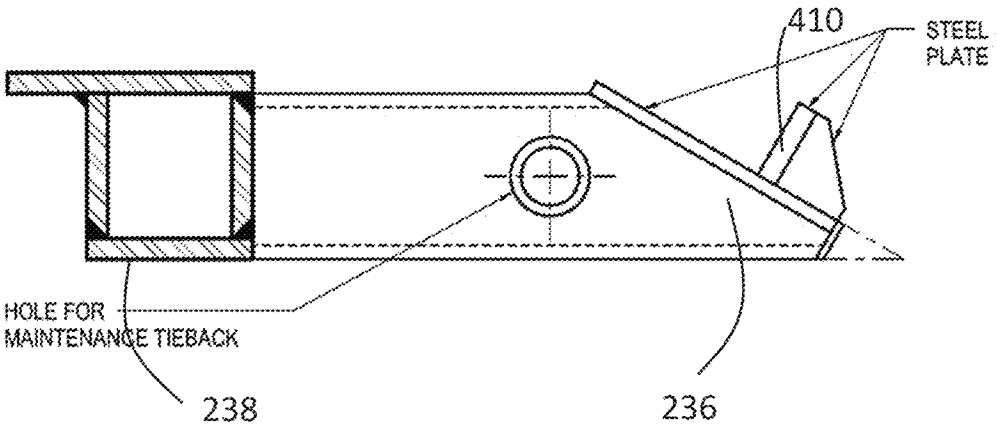
Figure 4F:
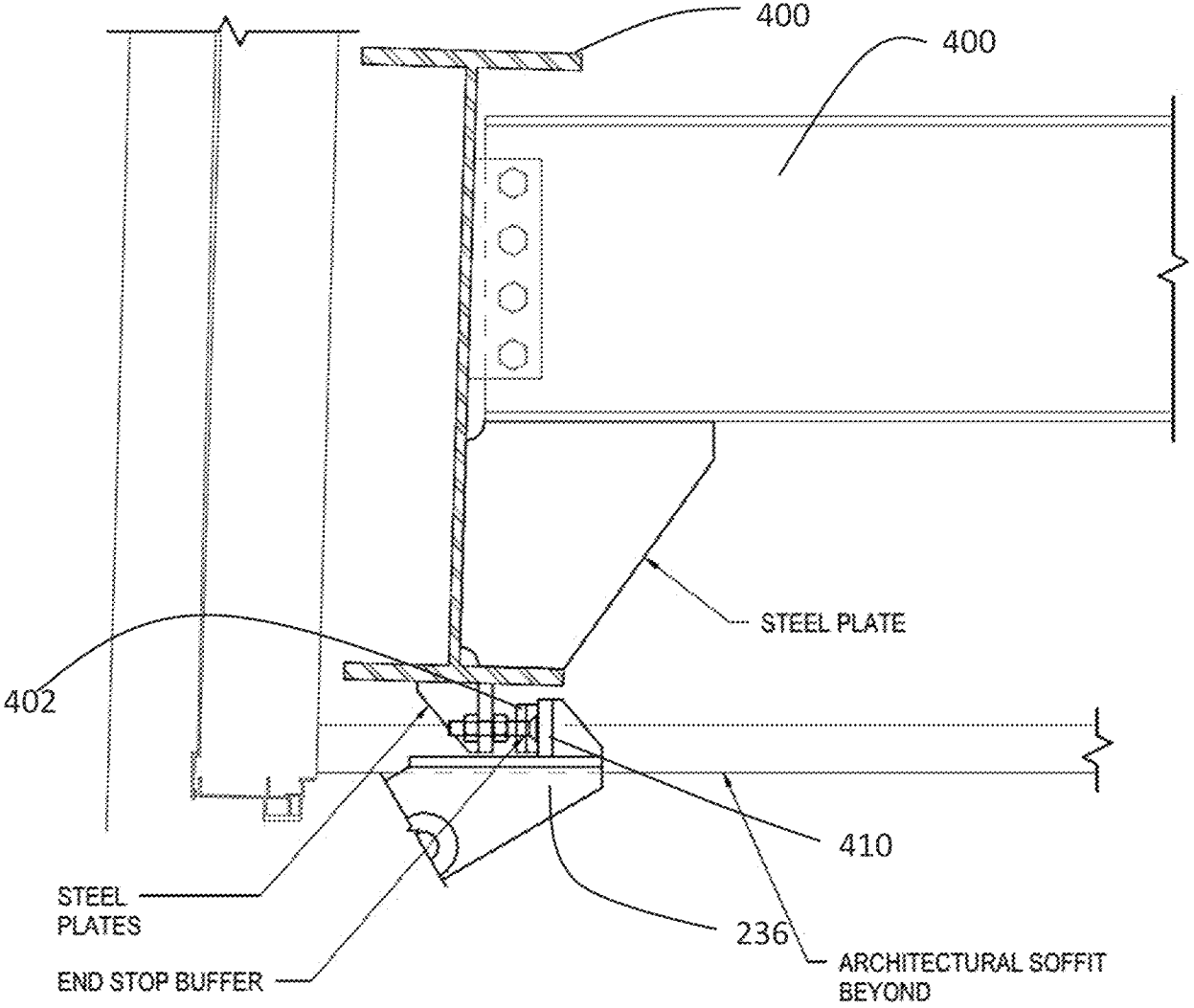
Figure 4G:
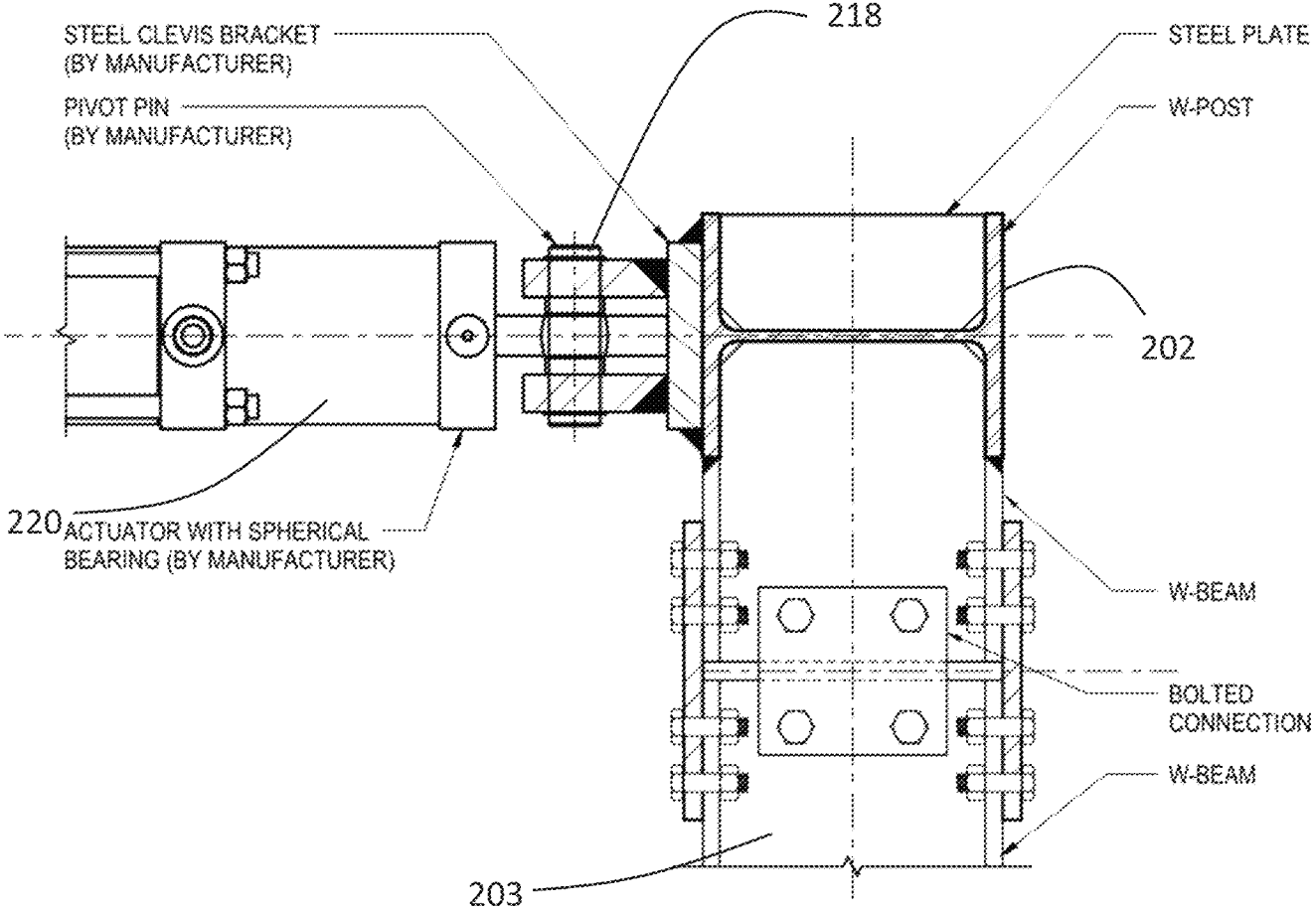

FIG. 4E is an exemplary construction diagram for a tilting ride according to some embodiments of the present invention. FIG. 4E shows a side sectional view of end stop 236 attached to platform frame crossbeam 238. End stop engaging area 410 engages end-stop buffer 402 as shown in FIG. 4F to prevent platform 101 from tilting beyond its designed maximum.

FIG. 4F is an exemplary construction diagram for a tilting ride according to some embodiments of the present invention. FIG. 4F shows a side sectional view of end stop engaging area 410 of end stop 236 resting against end stop buffer 402 when platform 101 is fully tilted. The engagement of end stop 236 and buffer 402 combines with the stroke of the actuator 220 to prevent the platform 101 from tilting beyond its designed maximum tilt angle. End stop buffer 402 is securely attached to existing building support beams such as support beams 400. End stop buffer 402 is constructed to allow fine adjustment of the buffer point.

FIG. 4G is an exemplary construction diagram for a tilting ride according to some embodiments of the present invention. FIG. 4G shows a top sectional view of the attachment of actuator 220 to actuator pivot pin 218 and the attachment of pivot pin 218 to back post 202. The attachment of supporting crossbeam 203 to back post 202 is also shown. Actuator 220 pivots about actuator pivot pin 218 as actuator 220 expands and retracts.

While the invention has been described with respect to a limited number of embodiments, it will be appreciated that many variations, modifications and other applications of the invention may be made.

What is claimed is:

1. A system for a tilting amusement ride installed in a supporting structure and intended to bring a rider from a standing vertical position, to a tilted position while the rider remains prone, comprising: a) a tilting platform comprising at least one cell to accommodate a rider; b) at least one actuator attached at its extending end to said platform by a pivoting attachment, wherein said actuator extends to tilt said platform and retracts to retract said platform; c) at least one back post attached to said at least one actuator at its fixed end by a pivoting attachment and securely attached to said structure; and d) a supporting frame attached to said platform by a rotational pivot, wherein said platform tilts about said pivot and wherein said frame is securely attached to said structure; wherein said platform has an angle of tilt between 15 and 45 degrees.

2. The system of claim 1, wherein said angle of tilt is between 25 and 35 degrees.

3. The system of claim 1, wherein said cell comprises a) at least two L-frames defining the sides of said cell; b) a glass front that is faced by the rider standing in the cell; and c) a glass top.

4. The system of claim 3, wherein said glass front and said glass top comprise heat treated glass lites with structural interlayers.

5. The system of claim 3, wherein said cell further comprises at least one handrail.

6. The system of claim 3, wherein said platform further comprises: a) a base attached to the bottom of said at least two L-frame, said base comprising a support member covered on its top by a floor; and b) a crossbeam perpendicularly attached to said at least two L-frames.

7. The system of claim 6, wherein said floor comprises a non-slip material.

8. The system of claim 1, further comprising an end stop attached to said platform, wherein said end stop engages an end stop buffer when said platform is fully tilted.

9. The system of claim 1 wherein the tilting platform does not provide substantial movement in any other direction aside from the tilt.

10. The system of claim 1, wherein said ride is retrofitted into an existing supporting structure.

11. The system of claim 1, wherein said ride is constructed as part of the construction of the supporting structure.

12. The system of claim 1 further comprising a supporting crossbeam attached to said at least one back post.

13. The system of claim 1, wherein said supporting frame further comprises supporting beams attached to form a frame and wherein said supporting beams are securely attached to said structure with support posts.

14. The system of claim 1, wherein said actuator is selected from the group consisting of: a hydraulic actuator; an electro-mechanical actuator; and a pneumatic actuator.

15. The system of claim 1 wherein said ride is flush with said structure when retracted.

16. The system of claim 1 wherein said ride protrudes from said structure when retracted.

17. A system for a tilting amusement ride installed in a supporting structure and intended to bring a rider from a standing vertical position, to a tilted position while the rider remains prone, comprising: a) a tilting platform comprising at least one cell to accommodate a rider; wherein said platform tilts about a rotational pivot attached to said structure; and b) at least one actuator attached at its extending end to said platform by a pivoting attachment, wherein said actuator extends to tilt said platform and retracts to retract said platform; wherein said actuator is attached to said structure.

18. The system of claim 17, wherein said tilted position has an angle of tilt, and wherein said angle of tilt is between 15 and 45 degrees.

19. The system of claim 18, wherein said angle of tilt is between 25 and 35 degrees.

20. The system of claim 17 wherein the tilting platform does not provide substantial movement in any other direction aside from the tilt.

* * * * *